United States Patent [19]

Ellis

[11] 4,346,539

[45] Aug. 31, 1982

[54] LATTICE BEAM-COLUMNS

[75] Inventor: John S. Ellis, Kingston, Canada

[73] Assignee: Her Majesty the Queen as represented by the Minister of National Defence of Her Majesty's Canadian Government, Ottawa, Canada

[21] Appl. No.: 126,999

[22] Filed: Mar. 3, 1980

[30] Foreign Application Priority Data

Mar. 29, 1979 [CA] Canada ..... 324564

[51] Int. Cl.[3] ..... E04C 3/10

[52] U.S. Cl. ..... 52/226; 52/657

[58] Field of Search ..... 52/655, 657, 226, 225, 52/223 R

[56] References Cited

U.S. PATENT DOCUMENTS

| | | | |
|---|---|---|---|
| 357,290 | 2/1887 | Putnam | 52/226 |
| 798,021 | 8/1905 | Eck | 52/226 |
| 1,656,861 | 1/1928 | Leonard | 52/226 |
| 1,658,535 | 2/1928 | Neilson, Sr. | 52/225 |
| 2,092,022 | 9/1937 | Rieger | 52/226 |
| 2,126,511 | 8/1938 | Soule | 52/226 |
| 3,100,555 | 8/1963 | Ashton | 52/655 |
| 3,358,994 | 12/1967 | Miller | 52/223 R X |
| 3,380,209 | 4/1968 | Cheskin | 52/655 X |

FOREIGN PATENT DOCUMENTS

| | | |
|---|---|---|
| 581580 | 8/1959 | Canada . |
| 636640 | 2/1962 | Canada . |
| 843058 | 6/1970 | Canada . |
| 1009016 | 4/1977 | Canada . |

*Primary Examiner*—Carl D. Friedman

*Attorney, Agent, or Firm*—Larson and Taylor

[57] ABSTRACT

A prestressed structural member is described in which there is provided in combination a pair of longitudinal elements, a plurality of strut elements, a plurality of diagonal members and a plurality of joint connector means for rigidly interconnecting the strut elements and diagonal elements together and the same to the longitudinal elements. The longitudinal elements are spaced apart and prestressed in compression. The strut elements are also spaced apart and each strut element extends between the longitudinal elements, and is disposed orthogonally of a line equidistant from each longitudinal element. The strut elements are also prestressed in compression. The diagonal members are oriented diagonally in pairs in box sections or bays delimited by the longitudinal and strut elements and with the strut elements form a lattice structure. The diagonal members are prestressed in tension. The joint connector means rigidly interconnect adjacent ends of the strut elements and diagonal members in said lattice structure. The joint connector means are configured to interconnect the longitudinal and strut elements with the diagonal members in a manner which deliberately provides a predetermined eccentricity of forces carried by each diagonal member relative to the geometrical intersection of axes of the strut and longitudinal elements.

11 Claims, 7 Drawing Figures

JUST BEFORE COLLAPSE

UPON COLLAPSE

LATTICE BEAM-COLUMNS

This invention relates to a structural member, such as that used in towers, tower cranes, trusses for space decks, temporary bridging, masts, or the like. More particularly, this invention relates to an improved prestressed lattice beam-column, having improved load carrying capabilities. As used herein, a beam-column is a structural member capable of carrying both transverse and axial loads.

BACKGROUND AND DESCRIPTION OF PRIOR ART

Structural members of the type envisaged herein have been known and used for some time. See, for example, Canadian Pat. Nos. 636,640 issued Feb. 20, 1962 to Josef Pfistershammer; 843,058 issued June 2, 1970 to Luis R. Zamorano; 581,580 issued Aug. 18, 1959 to Space Decks Limited and 1,009,016 issued Apr. 26, 1977 to Simpson Manufacturing Co., Inc.

The No. 636,640 patent describes a support structure that is produced from particularly hard material having thin walls. The structures are configured in a manner so as to adapt constantly to the increasing and decreasing buckling moments within each member. However, although there may be some superficial similarity with configurations envisaged herein, the No. 636,640 patent does not use a mixture of prestressed elements. Thus, this patent No. 636,640 does not teach the use of diagonal members prestressed in tension combined with strut and longitudinal elements prestressed in compression, as disclosed herein.

Canadian Pat. No. 843,058 does disclose a prestressed structural member, however, all elements of the lattice work therein are "strictly in tension". See page 1 at lines 3–4, or page 2 at lines 21–24. Thus, that patent precludes any structures in which the trusswork involves lattice elements prestressed in a combination of tensile and compressive forces.

SUMMARY OF THE INVENTION

Accordingly, the present invention is thought to embody prestressed lattice beam-columns having characteristics and properties which improve upon prior art structures illustrated in the above patents. The present invention provides a prestressed structural member/-truss which has improved strength properties. Further, compared to some prior art structures of the same material and strength, prestressed structural members as envisaged herein will present a lower profile, i.e., reduced frontal area to wind forces, bomb blasts or the like.

The present invention also envisages prestressed structures built up in modular form, wherein fewer and stronger structural components are possible. Transportation and erection/handling costs to, and at, a job site can thus be reduced.

Further yet, these advantages are derived from prestressed lattice beam-columns constructed in a manner tending to be away from conventional lattice beam-columns. To wit, the present invention utilizes diagonal members prestressed in tension (combined with longitudinal and strut elements prestressed in compression) and whose geometrical axes are offset from the intersection of the axes of the longitudinal and strut elements. Indeed, the present invention desires a deliberate and predetermined amount of offsetting. That constrasts, for example, with the current standard (C.S.A. Standard 516.1) of the 1978 *Manual of the Canadian Institute of Steel Construction,* regarding alignment of members, wherein it states—"Axially loaded members meeting at a joint shall have their gravity axes intersect at a common point as practicable; otherwise the results of bending due to the joint eccentricity shall be provided for."

Accordingly, there is envisaged herein a prestressed structural member comprising a pair of longitudinal elements spaced apart and prestressed in compression; a plurality of strut elements spaced apart with each strut element extending between the longitudinal elements and disposed orthogonally of a line equidistant from each longitudinal element, the strut elements being prestressed in compression; a plurality of diagonal members diagonally oriented in pairs in box sections formed by the longitudinal and strut elements, thereby forming a lattice structure, the diagonal members being prestressed in tension; and a plurality of joint connector means rigidly interconnecting adjacent ends of the strut elements and diagonal members together and to the longitudinal elements in the lattice structure, each joint connector means being configured to interconnect the longitudinal and strut elements with the diagonal members in a manner deliberately providing predetermined eccentricity of forces carried by each diagonal member relative to the geometrical intersection of axes of the strut and longitudinal elements.

Also, according to a preferred form of the present invention, the predetermined eccentricity is derived from offsetting the diagonal members in a manner causing the axes thereof to intersect the axes of strut elements inwardly of the box section formed by the strut and longitudinal elements. In other words, the diagonals of contiguous box sections need not intersect one another at the strut which is common to each box section.

According to yet another form of the present invention, the preferred eccentricity is derived from offsetting the diagonal members in a manner causing projections of the axes thereof to intersect projections of the axes of strut elements. In other words, the diagonals of contiguous box sections need not intersect one another at the strut which is common to each box section.

Further yet, another preferred embodiment of the invention envisages a structural member as described above in which the longitudinal elements are parallel.

The present invention encompasses trusswork having members and elements of standard structural shape, i.e., an "L", or "T" cross-section. A preferred embodiment herein utilizes a combination of members and elements that are respectively solid, and tubular, typically being circular in cross-section. In other words, the diagonal members are solid and slender components, whereas the strut and longitudinal elements are tubular.

Other features and advantages of the present invention will become apparent from the detailed description below. That description is to be read in conjunction with the accompanying drawings which illustrate various forms of this invention.

DESCRIPTION OF THE PREFERRED EMBODIMENTS

Figure 1A:
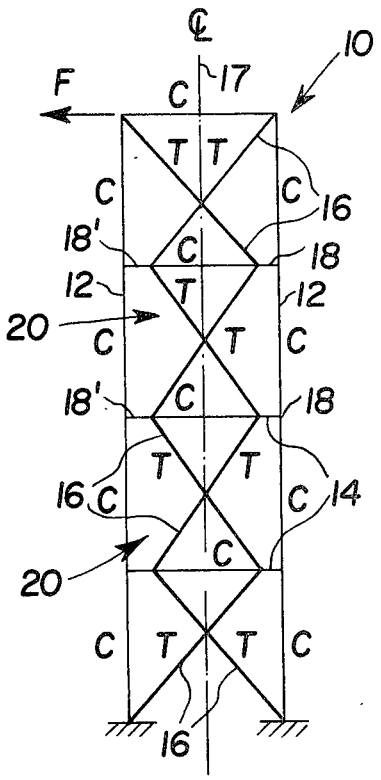
FIGS. 1*a* and 1*b* are schematic drawings illustrating one embodiment of the invention envisaged herein, shown respectively in vertical (upright) and horizontal orientations.
Figure 1B:
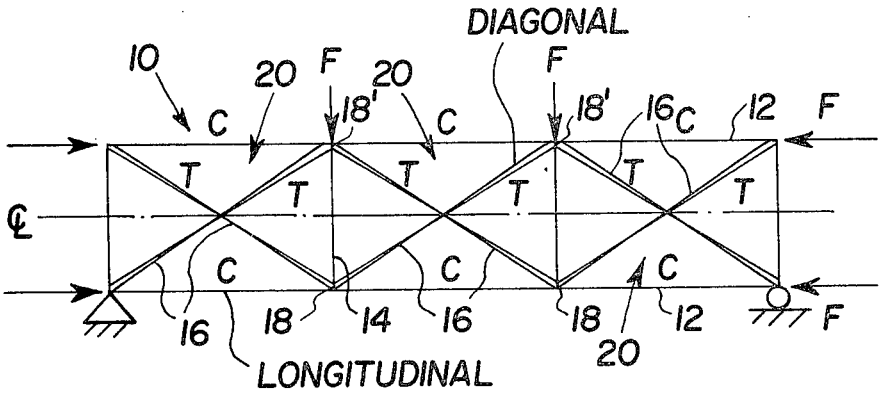

A prestressed structural member in the form of a lattice beam-column as envisaged herein, is shown overall at 10 in FIGS. 1(*a*), 1(*b*) and 2. This structural member 10 comprises a pair of longitudinal elements 12, strut elements 14 and diagonal members 16. The longitudinal elements 12 are spaced apart, equidistant from a centreline 17 extending therebetween. Each strut element 14 extends from one longitudinal element 12 to the other, preferably orthogonally of the centreline 17. Each strut element 14 has opposite ends 18 and 18' rigidly connected to the longitudinal elements 12 by suitable connector means to be described more fully below. Thus, the strut elements 14 are also spaced apart, longitudinally of the structural member 10, and together with the longitudinal elements 12 form a series of box sections or bays 20.

A pair of diagonal members 16 are provided in each box section 20, and extend generally diagonally across the same, thus forming therewith the latticework of the structural member 10. Members 16 are morticed and brazed, to lie in a common plane. Adjacent ends of diagonal members 16 are rigidly connected to the longitudinal and strut elements 12 and 14 by the connector means in connection with FIGS. 3 and 4.

Figure 2:
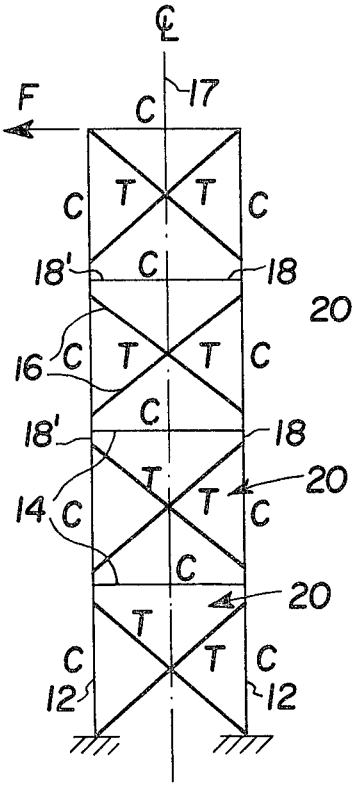
FIG. 2 is a schematic drawing illustrating another embodiment of the present invention, shown in an upright orientation.

It is emphasized, however, that in accordance with this invention the intersection of lines of forces carried by diagonal members 16 is off-set deliberately and by a predetermined amount from the intersection of the geometrical axes of the strut and longitudinal elements 14 and 12. In the embodiment of FIGS. 1(*a*) and 1(*b*), the joint connector means which couple the strut elements to the longitudinals, and the diagonal members to those two, is configured in a manner causing lines of forces carried by said diagonal members to intersect the axes of the strut elements 14 inwardly of the ends 18 and 18' thereof. In FIG. 2, the projection of lines of forces carried by the diagonal members 16 intersects the projection of axes of strut elements 14 outwardly of, or beyond the ends 18 and 18'. Put another way, the diagonal members 16 of FIG. 2 actually intersect the longitudinal elements 12. This deliberate offsetting of the joints of the diagonal members is variable, but preferably amounts to about 10% of the length of strut elements 14 at each end thereof.

In further accordance with this invention, the structural member 10 is prestressed with a combination of tensile and compressive forces. In fabricating the structural member 10, the strut elements 14 and diagonal members 16 were first connected rigidly together as an "inner structure", but left free, i.e., movable, relative to the longitudinal elements 12. A tensile load was applied to the inner structure in a manner described more fully in a co-pending Canadian patent application corresponding to U.S. Patent Application Ser. No. 126,998, naming Mr. Leonard H. Stirling as inventor, and being filed concurrently herewith. The tensile load was applied with lines of force colinear with the centerlines of the longitudinal elements 12. While that tensile load was being applied, the inner structure, i.e., the strut elements and diagonals were rigidly fastened to the longitudinal elements 12. When the tensile prestressing load (or force) was removed, the structural member 10 relaxed slightly. The diagonal members 16 were left containing a prestressing tensile force, and the strut elements 14 left with a prestressing compressive force, while the longitudinal elements 12 now assumed a compressive load.

Thus, FIGS. 1(*a*), 1(*b*) and 2 show the components of structural members 10 being prestressed either in tension (T) or in compression (C), but in each figure, with a combination of both such prestressing forces.

Figure 3:
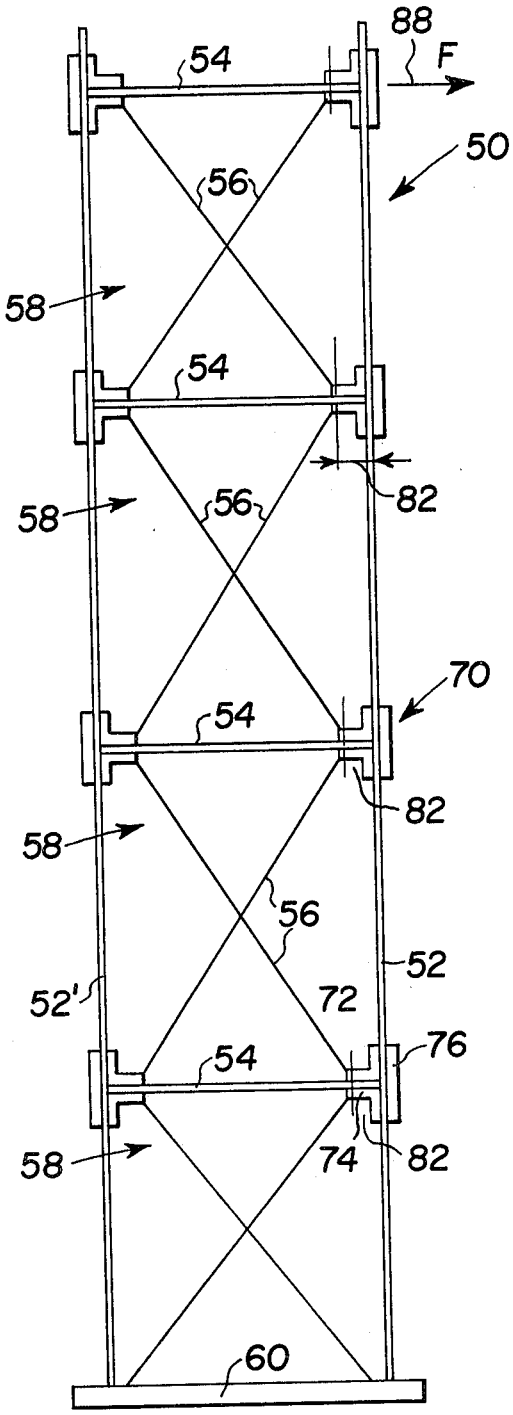
FIG. 3 is a schematic drawing showing in side elevation structural details of a prototype of the embodiment of this invention illustrated in FIG. 1*a*.
Figure 4:
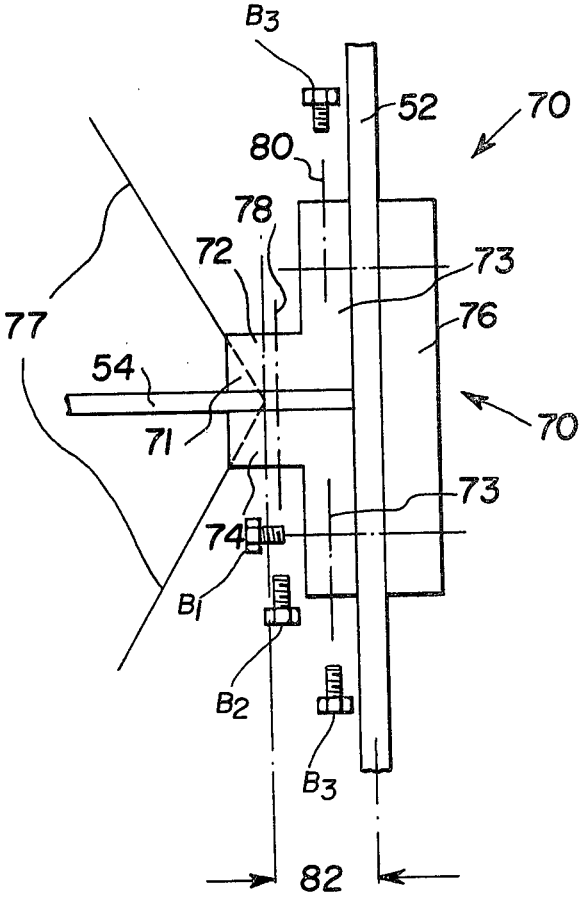
FIG. 4 is a schematic drawing showing in side elevation details of the joint used in the structure of FIG. 3.
Figure 5:
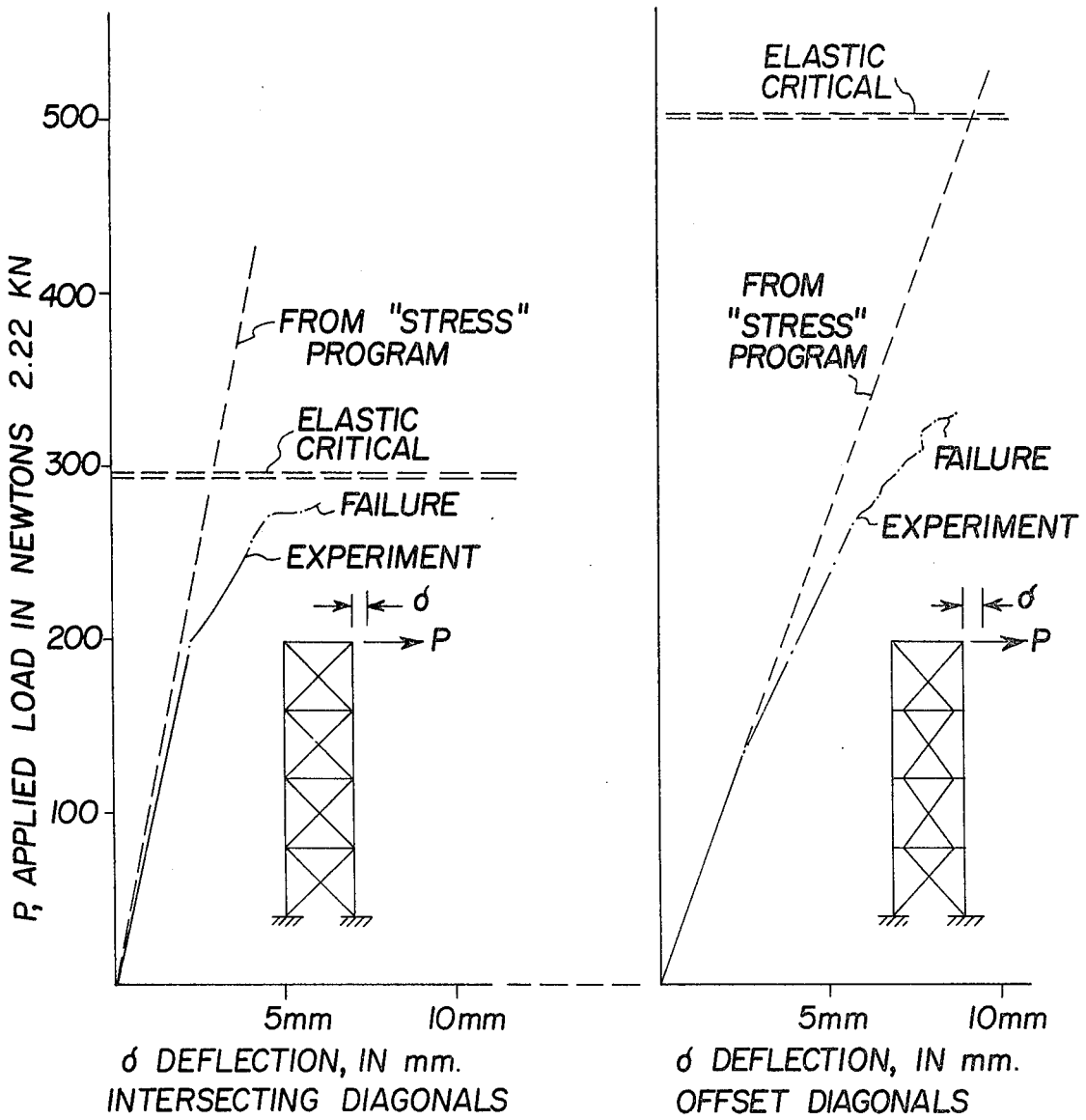
FIG. 5 is a graphical representation of the measured lateral deflection of the structure of FIG. 3, when loaded laterally.

Turning now to FIGS. 3, 4 and 5, a prototype structural member of the kind envisaged by this invention is shown overall at 50. Structural member 50 conforms to structural member 10 of FIG. 1(*a*), and thus includes longitudinal elements 52 and 52', crossarms or strut elements 54 and diagonal members 56. Thus, the longitudinal elements 52 and 52' and strut elements 54 are prestressed in compression, while the diagonals 56 are prestressed in tension.

In the prototype prestressed structural member 50, the longitudinals 52 and 52', the strut elements 54 were made of rectangular steel bars, dimensioned as 3 mm by 20 mm in cross-section. From a stress/strain curve of the material loaded in tension, the proportional limit for this steel was taken as 445 MPa. The diagonal members 56 were of high strength, solid steel rods of circular cross-section having a diameter of 3.175 mm. The steel had a proportional limit taken as 675 MPa. The lattice beam-column or structural member 50 was made of four box sections or bays 58. These box sections 58 were slightly off being square. The outermost box sections 58 measured 182 mm wide by 199 mm long. The two central box sections 58 measured 182 mm by 228 mm long. The structural member 50 was centred on a steel base 60 measuring 242 mm long by 12 mm thick by 20 mm wide, and had an overall height from the base 60 of 854 mm.

A rigid interconnection of the ends of diagonal members 56 and strut elements 54 to the longitudinal elements 52 is achieved by joint connector means shown overall at 70. See FIG. 4 particularly. Each joint connector means 70 in this instance comprises a pair of angle brackets 72 and 74, and a flat connecting plate 76. As indicated previously in describing the embodiment of FIG. 1, the strut elements 54 and diagonal members 56 are initially connected together as a rigid innerstructure or latticework. Thus, drilled openings were provided in the ends of each strut element 54 to be alignable with apertures provided in the feet and leg portions 71 and 73 of the angle brackets 72. The center lines of these openings are indicated at 78 and 80 in FIG. 4, with these openings being adapted to receive threaded bolts. The bolts were of 4 mm O.D. and the brackets were made of steel bar stock 6.5 mm thick by 20 mm wide.

In this particular prototype, diagonal members 56 were made of high strength solid steel rod, circular in cross-section. The feet portions 71 of the angle bracket 72 were accordingly drilled at an angle, to receive an end of the diagonal member 56. The centreline of those drill holes is shown at 77 in FIG. 4. The diagonal members 52 are rigidly connected to the brackets 72 and 74, preferably, by brazing or welding. A screw threaded interconnection could also be used or any other alternative which leaves the inner latticework capable of resisting the prestressing load to be applied to it. The angles of the drill holes indicated by centrelines 77 will vary somewhat depending on how square each box section or bay 58 is. This angle is typically in the range from about 30° to about 60°, preferably at about 45° taken from the axis of the strut elements 54. In the prototype illustrated in FIG. 3, those angles were slightly less than 60°. Each diagonal member 56 intersects the axis of strut elements 54 at a location offset inwardly of the geometrical intersection of the axes of longitudinal and strut elements 52 and 54. This offset in FIG. 3 was 16.58 mm, and is shown at 82 in both FIGS. 3 and 4.

Each of the longitudinal elements 52 and 54 is also provided with slots at appropriate locations alignable with drill holes in the leg portions 73 of the angle brackets 72. Again, 4 mm O.D. bolts were used to secure the pieces together rigidly. As seen from FIG. 4, the inner latticework involving the diagonals and strut elements 56 and 54 is readily secured together as a rigid unit, while still being freely movable relative to the longitudinals 52. In that condition of being movable relative to the longitudinal elements, a tensile load of 2.314 kilonewtons was applied longitudinally to that inner latticework. Full details of that prestressing operation are found in the aforementioned copending Canadian patent application corresponding to U.S. Patent Application Ser. No. 126,998, entitled "Pretensioning Diagonals in Lattice Beam-Columns" and filed concurrently herewith. While that prestressing tensile load was applied, the connecting plates 76 were rigidly fastened to the angle brackets 72 and 74, forming a rigid interconnection of the structural components 52, 54 and 56 by the joint connector means 70. Threaded fastening means indicated schematically in FIG. 4 by bolts $B_1$, $B_2$ and $B_3$ can be used to provide this rigid fastening. Upon release of the prestressing tensile load, the diagonals 56 remain in tension, the strut elements 54 remain in compression, and the longitudinal elements 52 acquire a prestressing compressive load.

As already noted, the total prestressing load applied to this prototype was 2.314 kN. Assuming the diagonals to be at an angle of 45°, the pretensioning stress in each diagonal is given by the following equation:

$$\sigma_p=(2.314\times 1{,}000\times 1.41)/(2\times A)$$

where A is the cross-sectional area of the diagonal. The calculated pretensioning stress for a diagonal of 3.175 mm diameter was 207 MPa, well below the proportional limit of the brazed diagonal. That figure took into account any stress relieving effects of the heat involved in brazing the ends of the diagonal members 56 into the joint connector means 70. The heat of brazing is thought to induce a decrease in the value of E, Young's Modulus. However, such a decrease was concluded as acceptable in view of the short length of diagonal involved in the brazing operation.

Testing of the load carrying capability was carried out using a laterally applied force shown by the arrow 88 in FIG. 3. The base end of the lattice beam-column 50 was held fixed. The table below shows the results achieved, as compared with the load capability of a similar beam-column which uses conventional intersecting diagonals, i.e., a beam-column in which lines of forces carried by the diagonals and the strut and longitudinal elements all intersect at a common point at each joint therein.

TABLE A

| CONFIGURATION OF DIAGONALS | FAILURE LOAD IN EXPERIMENT |
|---|---|
| Intersecting | 280 pounds |
| Intersecting | 276 pounds |
| Offset | 340 pounds |
| Offset | 328 pounds |

FIG. 5 shows the results of Table A graphically, with the righthand portion of that Figure representing the structural member 50 of FIG. 3 when loaded to failure. It is noted both from FIG. 5 and from Table A that prestressing of the lattice beam-column as described herein, coupled with the offsetting of the junction of the diagonals with the strut elements, yielded an increase of about 20% in the capability of the beam-column to resist lateral loading. That constitutes a significant improvement. The deliberate and predetermined amount of offsetting of diagonal members coupled with prestressing of the components in a combination of compressive and tensile loads will provide many advantages readily apparent to those knowledgeable in this art.

Figure 6:
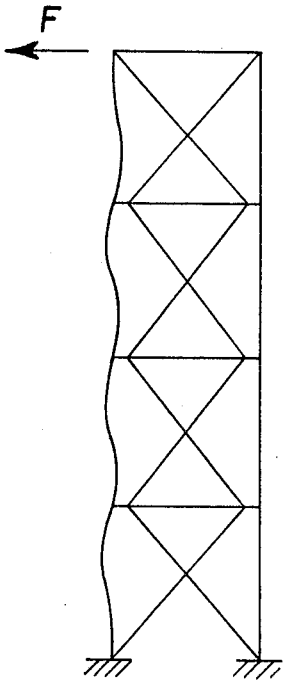
FIGS. 6 and 7 are schematic views showing in side elevation deformation of the structure of FIG. 3 just before, and upon collapse, of that structure loaded to failure.
Figure 7:
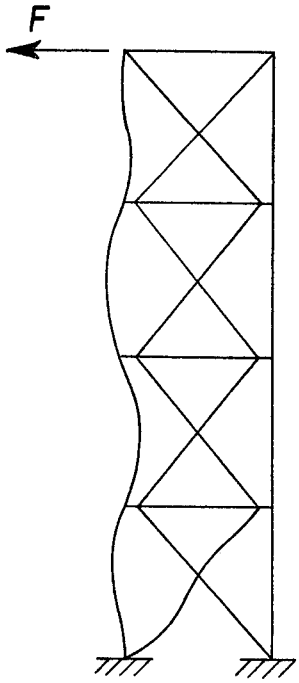

FIGS. 6 and 7 are intended to round out the experimental studies made on the prototype of FIG. 3, by showing schematically the extent of the buckling of a longitudinal element just before, and upon, collapse of the prototype beam-column illustrated in FIG. 3.

The theoretical predictions indicated graphically in FIG. 5 were derived from the conventional "stress" computer program familiar to practitioners in this art. Elastic critical loads were computed by J. L. Meek, *Reader in Structural Engineering of the University of Queensland,* Australia, as follows:

For intersecting diagonals—1.3 kN and

For offset diagonals—2.26 kN

The good agreement between the elastic critical load as computed by J. L. Meek, and the experimental results indicated the validity of using his approach which was based on a geometric stiffness matrix. However, the discrepancy occurring with the offset diagonal configuration raised the question of whether that approach was valid, since the following phenomena were neglected.

1. stress values in the plastic range;
2. changes in joint co-ordinates with increasing applied load; and
3. the contribution of flexure to the axial deformation of members.

It was thought that if plastic stresses were important, then the agreement for the intersecting diagonal configuration between theory and experiment would have been less close. Therefore, attention was directed towards the second and third phenomena noted above. The second phenomenon can be taken into account by "updating" the joint co-ordinates in the computer program "stress" as the load is increased. The third phenomena is under examination at the present time.

It will be readily apparent to practitioners in this art that various changes and modifications can be made to a structural member as envisaged by this invention. Clearly the cross-sectional shape of the component parts can be changed, and a synthetic plastics material could be used in some instances instead of steel. Further, it will be apparent that a multi-sided mast or tower can be constructed using modules made up of structural members of the kind illustrated in FIGS. 1-3, inclusive. In addition, the longitudinal elements of such structural members can be beneficially initially curved along their axes. Moreover, the joint connector means illustrated in FIG. 4 will clearly vary depending upon the cross-sectional shape of the longitudinal and strut elements, and the diagonal members. When using tubular or solid elements having a circular cross-section, a structural connector such as that shown in Canadian Pat. No. 1,034,336 issued on July 11, 1978 to Chemetron Corporation may be very convenient. Accordingly, it is intended that all such changes and modifications as would be obvious to persons skilled in this art are to be encompassed by the claims below.

The embodiments of the invention in which an exclusive property or privilege is claimed are defined as follows:

1. A prestressed structural member comprising:
(i) a pair of longitudinal elements spaced apart and prestressed in compression;
(ii) a plurality of strut elements spaced apart with each strut element extending between the longitudinal elements and disposed orthogonally of a line equidistant from each longitudinal element, the strut elements being prestressed in compression;
(iii) a plurality of diagonal members diagonally oriented in pairs of box sections formed by the longitudinal and strut elements, thereby forming a lattice structure, said diagonal members being prestressed in tension; and
(iv) a plurality of joint connector means rigidly interconnecting the strut elements, the diagonal members and the longitudinal members of the lattice structure, the ends of said diagonal members being connected to said strut elements and the connection between the diagonal members and the associated strut elements being substantially offset along the lengths of the associated strut elements from the intersection of the axes of the strut elements and the longitudinal elements in a manner deliberately providing predetermined eccentricity of forces carried by each diagonal member relative to the geometrical intersection of the axes of the strut and longitudinal elements, said diagonal members intersecting said strut elements inwardly of the intersection between the strut elements and the longitudinal elements and the point of intersection being offset from the intersection between the strut and longitudinal elements by a distance equal to about 10 percent of the length of the strut elements.

2. A prestressed structural member comprising:
(i) a pair of longitudinal elements spaced apart and prestressed in compression;
(ii) a plurality of strut elements spaced apart with each strut element extending between the longitudinal elements and disposed orthogonally of a line equidistant from each longitudinal element, the strut elements being prestressed in compression;
(iii) a plurality of diagonal members diagonally oriented in pairs in box sections formed by the longitudinal and strut elements, thereby forming a lattice structure, said diagonal members being prestressed in tension; and
(iv) a plurality of joint connector means rigidly interconnecting the strut elements, the diagonal members and the longitudinal elements of the lattice structure, the ends of said diagonal members being connected only to said longitudinal elements and the connection between the diagonal members and the associated longitudinal elements being substantially offset along the length of the associated longitudinal elements from the intersection of the axes of the strut elements and the longitudinal elements in a manner deliberately providing predetermined eccentricity of forces carried by each diagonal member relative to the geometrical intersection of the axes of the strut and longitudinal elements, said diagonal members intersecting said longitudinal elements at a predetermined distance from the intersection between the strut elements and the longitudinal elements to cause projections of a diagonal member intersecting projections of the corresponding strut elements outwardly of the corresponding intersection between the strut elements and the longitudinal elements, the points of intersection between the projections of the diagonal members and the projections of the strut elements being offset from the corresponding intersection between the strut elements and the longitudinal elements by a distance equal to about 10 percent of the length of the strut elements.

3. The prestressed structural member defined in claim 1 or 2 wherein diagonal members in box sections which are adjacent to one another are offset by different amounts.

4. A prestressed structural member comprising:
(i) a pair of longitudinal elements spaced apart and prestressed in compression;
(ii) a plurality of strut elements spaced apart with each strut element extending between the longitudinal elements and disposed orthogonally of a line equidistant from each longitudinal element, the strut elements being prestressed in compression;
(iii) a plurality of diagonal members diagonally oriented in pairs in box sections formed by the longitudinal and strut elements, thereby forming a lattice structure, said diagonal members being prestressed in tension; and
(iv) a plurality of joint connector means rigidly interconnecting the strut elements, the diagonal members and the longitudinal elements of the lattice structure, the ends of said diagonal members being connected to either said strut elements or said longitudinal elements and the connection between the diagonal members and the associated elements being substantially offset along the length of the associated elements from the intersection of the axes of the strut elements and the longitudinal elements in a manner deliberately providing predetermined eccentricity of forces carried by each diagonal member relative to the geometrical intersection of the axes of the strut and longitudinal elements, each said structural member comprising a plurality of said box sections including an upper box section and a lower box section, the connections of the lower ends of the diagonal members of the upper box section and the upper ends of the diagonal members of the lower box section being substantially offset from the intersection of the strut and longitudinal elements and the connections between the upper ends of the diagonal of the upper box sections and the lower ends of the diagonal members of the lower box sections being non-offset.

5. The prestressed structural member defined in claim 1, 2 or 4, wherein said longitudinal elements are parallel.

6. The prestressed structural member defined in claim 1, 2 or 4 wherein the diagonal members are of a high strength steel.

7. The prestressed structural member defined in claim 1, 2, or 4, wherein some of said diagonal members are of synthetic plastics.

8. The prestressed structural member defined in claim 1, 2 or 4 wherein said longitudinal and strut elements are tubular.

9. The prestressed structural member defined in claim 1, 2 or 4 wherein said diagonal members are solid, and of circular cross-section.

10. The prestressed structural member defined in claim 1, 2 or 4 wherein said joint connector means comprises a plurality of parts adapted to be rigidly secured together and to the diagonal members and strut and longitudinal elements by means of threaded fastening means.

11. The prestressed structural member defined in claim 1, 2 or 4 wherein said joint connector means comprises an unity casting suitably configured to enable the diagonal members and strut elements to be secured rigidly thereto, and enabling said connector means to be rigidly secured to said longitudinal elements.

* * * * *